US006196764B1

(12) United States Patent
Bayssiguier

(10) Patent No.: US 6,196,764 B1
(45) Date of Patent: Mar. 6, 2001

(54) AUTOMATIC WICKET FOR A HYDRAULIC STRUCTURE

(75) Inventor: Julien Bayssiguier, Nanterre (FR)

(73) Assignee: Hydroplus, Nanterre (FR)

( * ) Notice: Subject to any disclaimer, the term of this patent is extended or adjusted under 35 U.S.C. 154(b) by 0 days.

(21) Appl. No.: 09/101,902

(22) PCT Filed: Jan. 14, 1997

(86) PCT No.: PCT/FR97/00056

§ 371 Date: Jan. 12, 1999

§ 102(e) Date: Jan. 12, 1999

(87) PCT Pub. No.: WO97/26412

PCT Pub. Date: Jul. 24, 1997

(30) Foreign Application Priority Data

Jan. 19, 1996 (FR) ..... 96 00575

(51) Int. Cl.[7] ..... E02B 7/40

(52) U.S. Cl. ..... 405/102; 405/87; 405/92; 405/100

(58) Field of Search ..... 405/92, 101, 104, 405/94, 80, 87, 100, 102

(56) References Cited

U.S. PATENT DOCUMENTS 4,352,592 * 10/1982 Aubert ..... 405/101 X
4,455,106 * 6/1984 Johnson ..... 405/101 X
5,222,834 * 6/1993 Schultz ..... 405/94
5,758,989 * 6/1998 Snowberger ..... 405/92 X

FOREIGN PATENT DOCUMENTS

0983178 * 12/1982 (SU) ..... 405/94

* cited by examiner

*Primary Examiner*—Dennis L. Taylor
(74) *Attorney, Agent, or Firm*—Amster, Rothstein & Ebenstein

(57) ABSTRACT

An automatic flashboard (10) comprises a wall (12) installed on a hydraulic structure (11) so as to be capable of passing from an erect position in which it retains a mass of water to a lowered position in which it allows the water to pass substantially without obstruction, and at least one elongate retaining member (13) for holding the wall (12) in its erect position against horizontal thrust ($P_1$) from the mass of water (25). The retaining element (13) extends between the wall (12) and a reaction point to which it is connected by a connection (15) that can be automatically eliminated when the water reaches a certain level. The flashboard (10) also includes a massive element (16) movably mounted on the structure (11) and coupled to the mass of water so as to be in a stable state so long as the water remains below a predetermined level (N) and to pass into an unstable state and to be moved when the water reaches the predetermined level (N), the connection (15) being eliminated by the massive element moving.

28 Claims, 9 Drawing Sheets

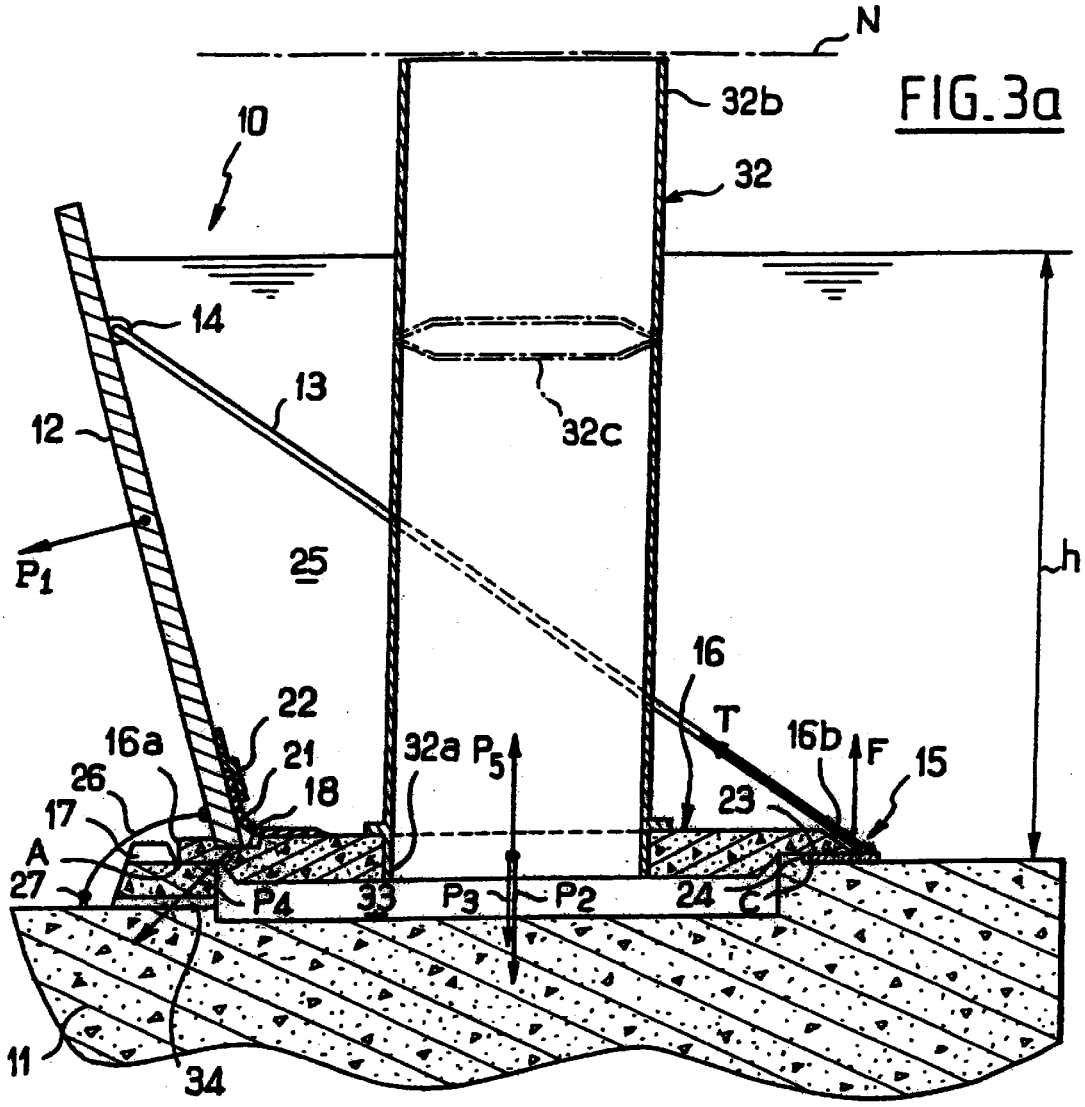
FIG.5a
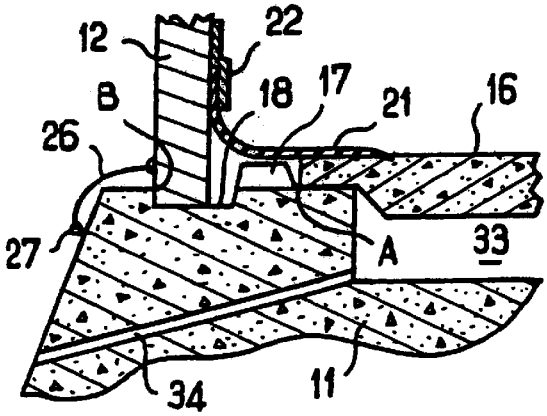
FIG.5b
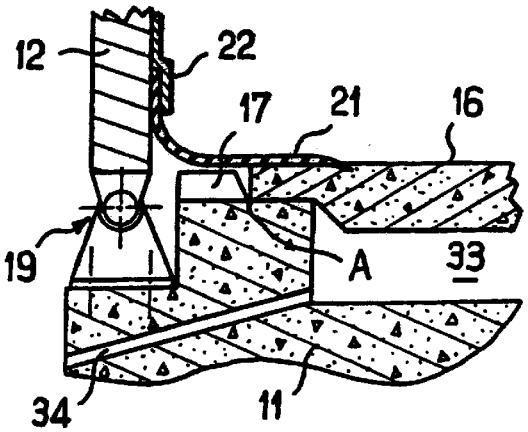

AUTOMATIC WICKET FOR A HYDRAULIC STRUCTURE

The present invention relates to an automatic flashboard for a hydraulic structure such as a weir, or a spillway on a dam or on a protective embankment, the flashboard being of the type comprising a watertight or substantially watertight wall installed on said structure so as to be capable of passing from an erect, first position for retaining a mass of water to a lowered, second position in which said wall allows water to pass practically without obstruction, and at least one elongate retaining element for holding said wall in its first position against the horizontal thrust exerted by the mass of water, said elongate retaining element being subjected in operation under thrust from the water to a longitudinal force, extending between said wall and a reaction point counterbalancing said longitudinal force, and being connected to the reaction point via a connection that can be eliminated automatically when the water reaches a certain level, such that said wall passes automatically to its second position.

Automatic flashboards of that type are well known. Usually, such automatic flashboards are installed, e.g. on the top of a weir disposed across a river, in order to raise the level of water in the river upstream from the weir. They can also be installed on a dam spillway in order to raise the level of the reservoir retained by the dam. They can also be installed on the top of the spillway of an embankment bordering a river and intended to protect adjacent regions against the river flooding, in which case the spillway is installed in the embankment at a location that is chosen so that in the event of a flood, water flows into a storage reservoir or onto selected ground without danger for other regions adjacent to the river. Automatic flashboards can be of the non-overflow type or of the overflow type, i.e. in the second case they can allow a certain quantity of water to pass over the top thereof so long as the water level upstream from the flashboard does not exceed a predetermined height. Nevertheless, in all cases, automatic flashboards must be capable of moving out of the way automatically if the water level upstream from the flashboard reaches a predetermined level during a flood in order to release the mass of water it is retaining and thus avoid flooding regions adjacent to the river or, as the case may be, damaging the embankment or the dam.

FIG. 1 of the accompanying drawings is a diagram in side elevation of a known automatic flashboard of the above-defined type, which can be considered representing the state of the art closest to the present invention. A model of that known automatic flashboard was exhibited at the International Congress on Large Dams which was held at Durban in the Republic of South Africa in November 1994. The known automatic flashboard shown in FIG. 1 is essentially constituted by a vertical or sloping plate 1 whose base is hinged to the top 2 of a masonry weir or spillway 3 by means of a hinge 4 or other similar element. The plate 1 is held in its erect position as shown in solid lines in FIG. 1 by means of a tension member 5 having one end connected to the plate 1 near the top thereof and having its other end connected to the masonry of the weir or spillway 3 by means of a fastening 6 which is shown in greater detail in FIG. 2 of the accompanying drawings. As shown in FIG. 2, the fastening 6 comprises two parts 6*a* and 6*b* which are fixed respectively to the masonry of the weir or spillway 3 and to the tension member 5, and a pin 6*c* which is engaged in aligned holes formed through parts 6*a* and 6*b* and which couples those two parts together.

In operation, the mass of water 7 retained by the plate 1 exerts thrust thereon. As a result, the tension member(s) 5 are under tension and consequently the pin 6*c* of the fastening 6 is subjected to a shear force. The magnitude of the shear force is proportional to the magnitude of the tension in the member 5 which is itself proportional to the magnitude of the thrust exerted by the mass of water 7 on the plate 1. The magnitude of said thrust is itself an increasing function of the level of the mass of water 7, i.e. the height of the water above the top 2 of the weir or spillway 3. When the magnitude of the shear force reaches and exceeds the shear strength of said pin 6*c* due to the water level rising, the pin 6*c* breaks, and under the thrust of the water, the plate 1 automatically drops down onto the top 2 of the weir or spillway 3 by pivoting about the axis of the hinge 4 until it takes up the position shown in dashed lines in FIG. 1.

Thus, by selecting the diameter and/or the material (generally steel) of the pin 6*c* so that it has appropriate shear strength, it is possible to ensure that the pin 6*c* of the fastening 6 breaks under predefined water loading, and thus when the water level upstream from the plate 1 reaches a predefined level. However, in practice, experience shows that the water level that causes the pin 6*c* to shear is not precise and can vary over a range of several tens of centimeters. Even assuming that the steel used has excellent properties, and also assuming consistent production quality, results of strength tests performed on steel samples cut from a single steel bar of diameter machined with great accuracy generally present a large amount of dispersion.

In spite of the apparent simplicity of the known automatic flashboard described above, it is highly probable that the plate 1 will be triggered prematurely, i.e. folded down to its low position before the water level reaches the predefined level, or that the plate 1 will be triggered too late, i.e. when the water level is higher than the predefined level; with these situations constituting a drawback from the reliability point of view in the first case and a drawback from the safety point of view in the second case. It is therefore highly desirable for the automatic flashboard to be capable of being triggered automatically with greater precision concerning water level.

Other designs of flashboard are described in U.S. Pat. No. 2,118,535 and in the publication "Engineering for dams" by W. P. Creager, Vol. III, pp. 870 to 878, published by Chapman and Hall, London, 1945. The flashboard described in U.S. Pat. No. 2,118,535 and the flashboard shown in FIG. 1 on page 872 of the publication "Engineering for dams" are entirely similar in structure. Those two flashboards are essentially constituted by vertical plates or panels which are held against water thrust by vertical stakes whose bottom ends are embedded in the masonry of the weir or spillway and which have the downstream faces of the vertical plates or panels pressing against the full height thereof. In both cases, the flashboards are automatic. The stakes are made of steel bars or tubes of section selected so that the stakes fold or break for a given water loading applied to the vertical plates or panels. Concerning the precision of the water level that causes the stakes to fold or break, those known flashboards suffer from the same fault as the known automatic flashboard described above with reference to FIG. 1 of the accompanying drawings (in this respect, reference may be made to the publication "Engineering for dams", page 872, 3rd paragraph and page 874, 8th paragraph).

The flashboard shown in FIG. 5 on page 877 of the above-specified publication "Engineering for dams" is essentially constituted by one or more panels whose bottom ends press against a seat formed on the masonry of the weir or spillway and whose top ends are attached by means of bolts to a gangway passing over the weir or spillway. Each panel is constituted by a metal frame slidably receiving bulkhead plates. The metal frame is connected to the gangway by slack chains. The bolt(s) must be actuated by an operator to detach the panel(s) and release the mass of water retained thereby, which means that that flashboard does not operate automatically. It would be easy to design means for causing said flashboard to operate automatically by replacing the moving element of the bolt by a shear pin similar to that described with respect to the known automatic flashboard described with reference to FIGS. 1 and 2 of the accompanying drawings. Nevertheless, even in that case, the flashboard would still suffer from the same defect as the previously described known flashboard concerning precision of the water level at which the shear pin breaks.

The flashboard shown in FIG. 6 on page 878 of the above-specified publication "Engineering for dams" is essentially constituted by one or more panels which are hinged at their bottom ends to the masonry of the weir or spillway and which are retained against the water thrust by a plurality of rigid stays or struts disposed on the downstream side of the panels. There again, the flashboard is not automatic. To enable the panels to move out of the way, a knotted cord is provided that is threaded through holes pierced in the middles of all of the stays and that serves to enable the stays to be broken and/or retracted by an operator exerting traction on the cord.

Automatic flashboards are also known that are constituted by one or more massive elements placed on the top of a spillway and which are toppled over and swept away automatically by the water when it reaches a predetermined level (French patents 2 656 354 and 2 671 116). Those latter automatic flashboards have the advantage of operating with good precision with respect to the water level at which the flashboard element(s) is/are removed (said precision being to within a few centimeters). However they suffer from the drawback that the massive element(s) is/are lost once they have been swept away by the water.

An object of the present invention is thus to provide an automatic flashboard of the type defined in the preamble, which operates better than known automatic flashboards of the same type with respect to the precision of the water level at which the flashboard is triggered.

To this end, the flashboard of the present invention is characterized in that it further comprises a massive element movably mounted on said structure and coupled to said mass of water so as to be in a position of stable equilibrium so long as the water remains below a predetermined level and so as to pass into an unstable state and be displaced when the water reaches said predetermined level, and in that the connection between said elongate retaining element and the reaction point is eliminated by the displacement of said massive element.

In an embodiment of the present invention, said massive element may be constituted by a slab installed on said structure so as to be capable of tilting upwards about a horizontal axis which extends along a first side of the slab and which is perpendicular to the direction of the thrust exerted by the mass of water on the moving wall forming the flashboard. In another embodiment of the present invention, the massive element may be mounted so as to be capable of sliding vertically in an upwardly open cavity formed in said structure. The elongate retaining element may be constituted either by a tension member or by a strut. In both cases the connection between the tension member or the strut and the reaction point can be eliminated in response to the tilting or sliding movement of the massive element.

Other characteristics and advantages of the present invention appear more clearly from the following description of various embodiments of the present invention, given with reference to the accompanying drawings, in which.

Figure 3:
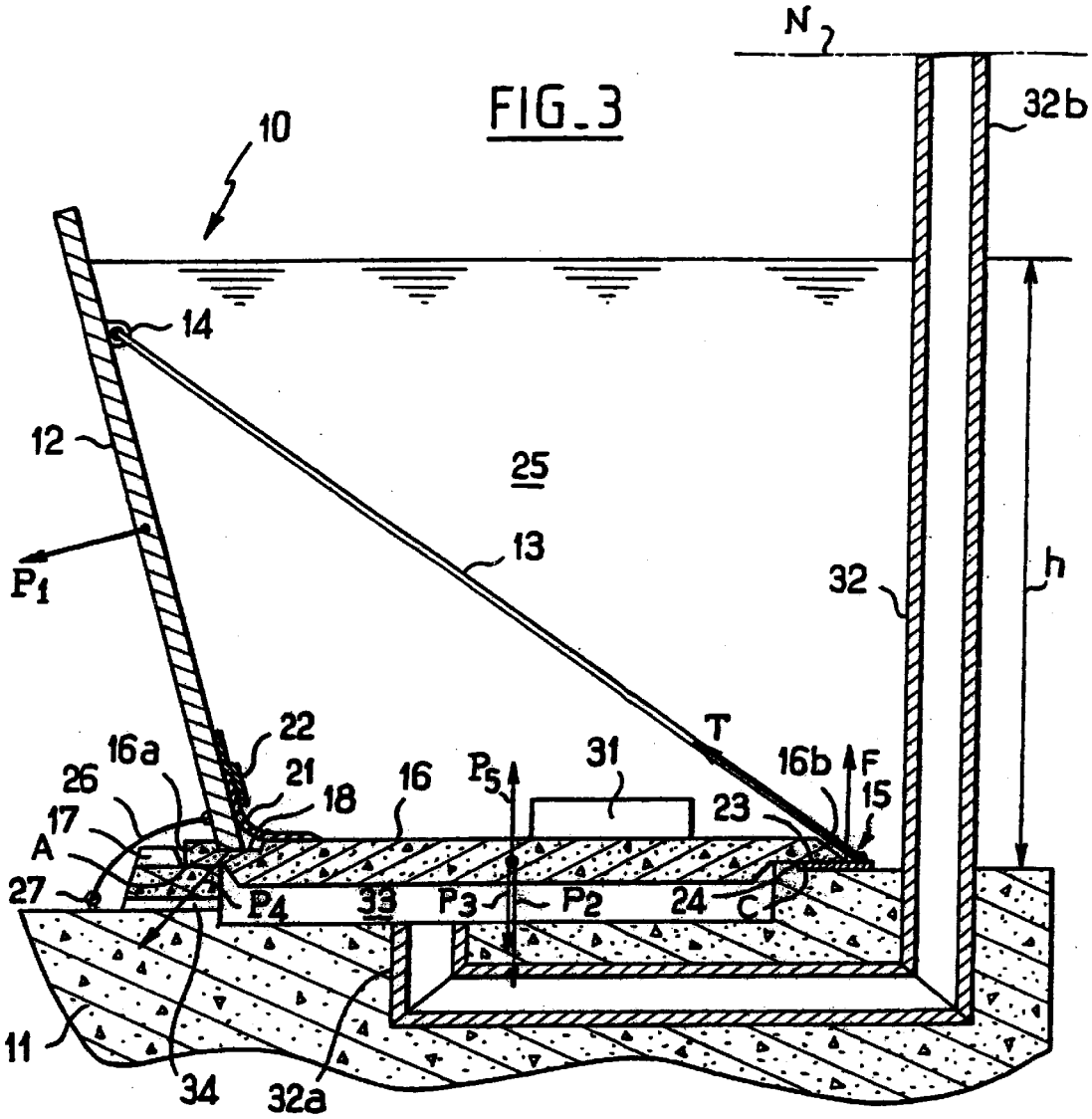
FIG. 3 is a diagrammatic vertical section showing an automatic flashboard constituting a first embodiment of the present invention.
Figure 6:
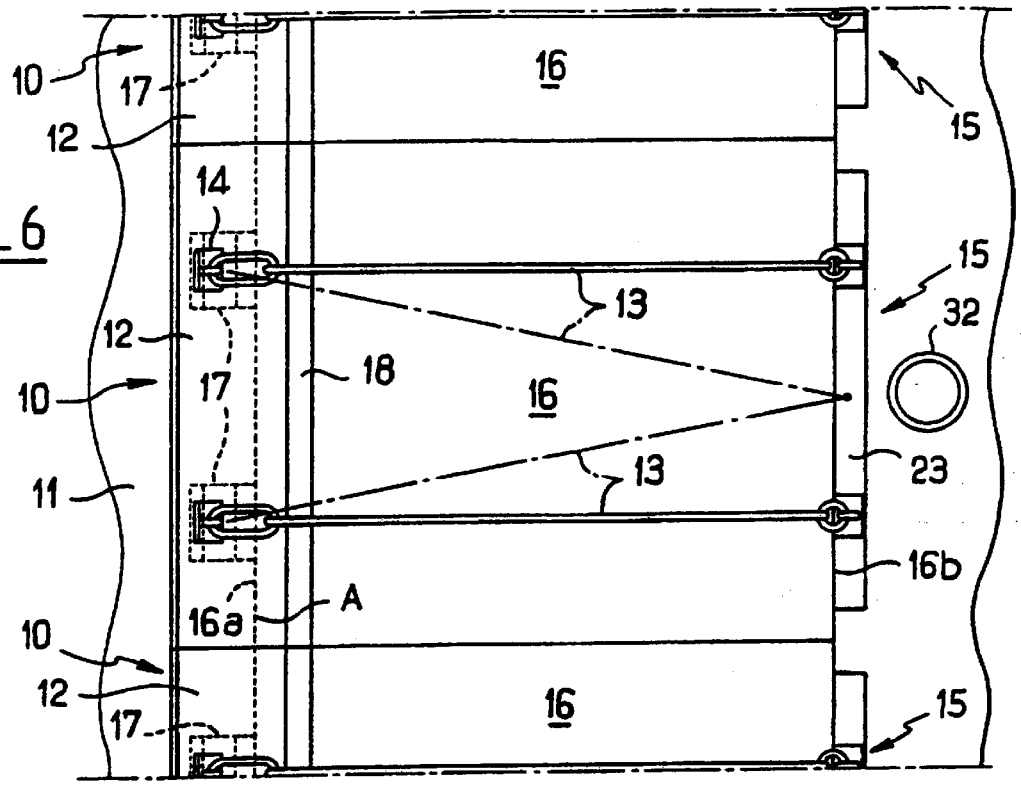
Figure 7:
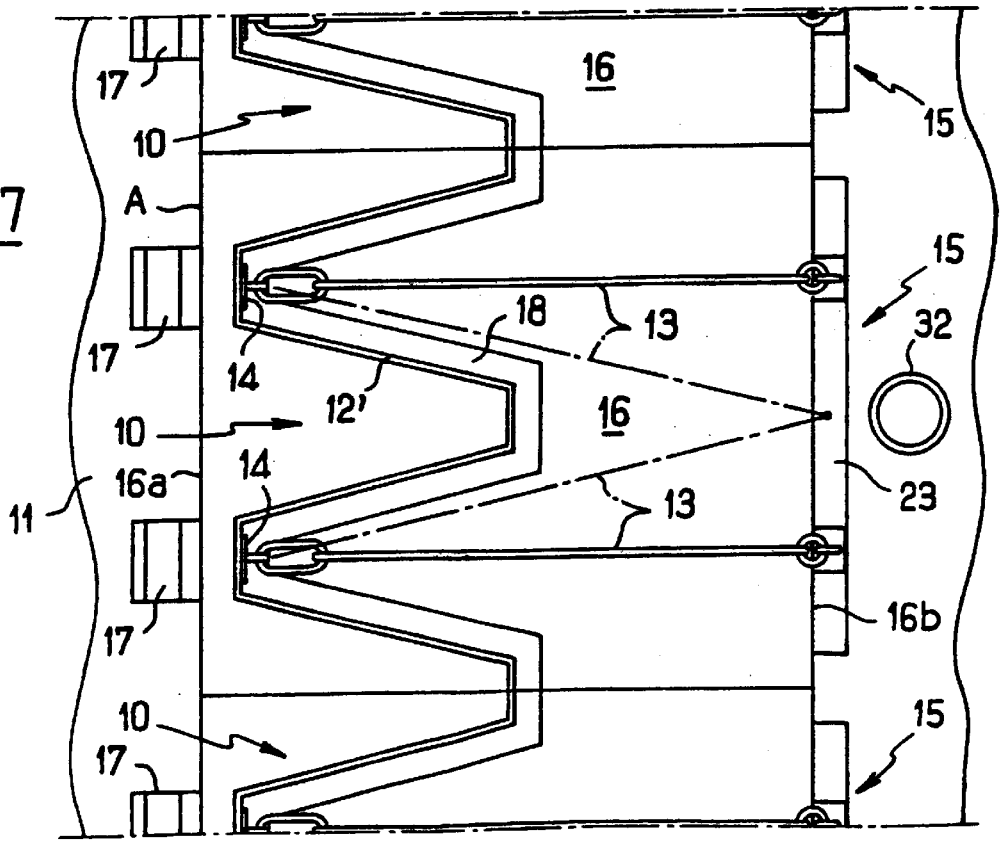
Figure 8:
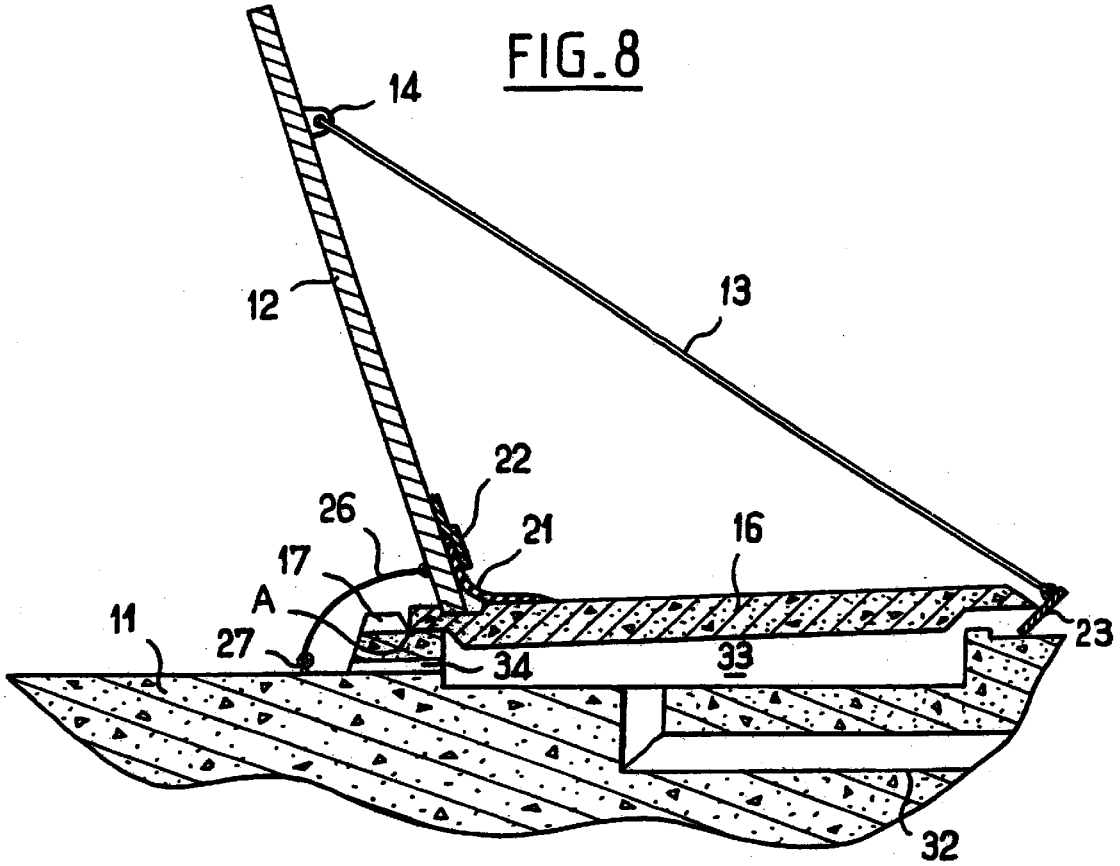
Figure 9:
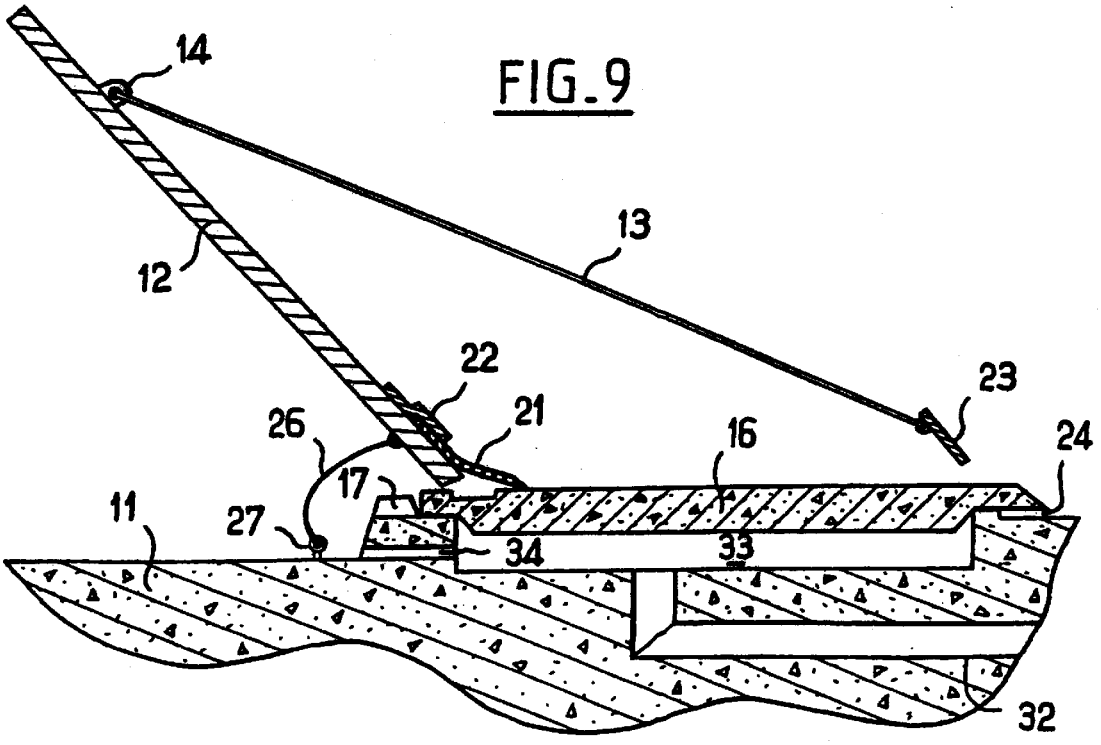
Figure 10:
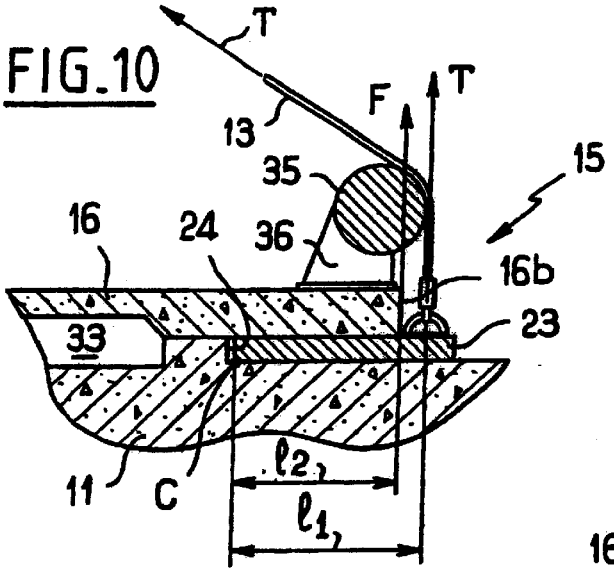
Figure 11:
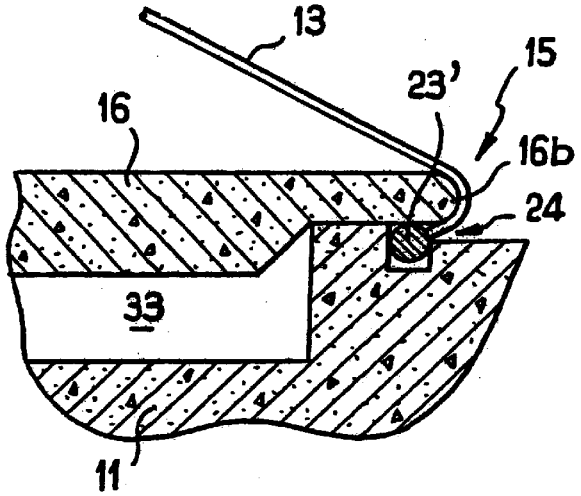
Figure 12:
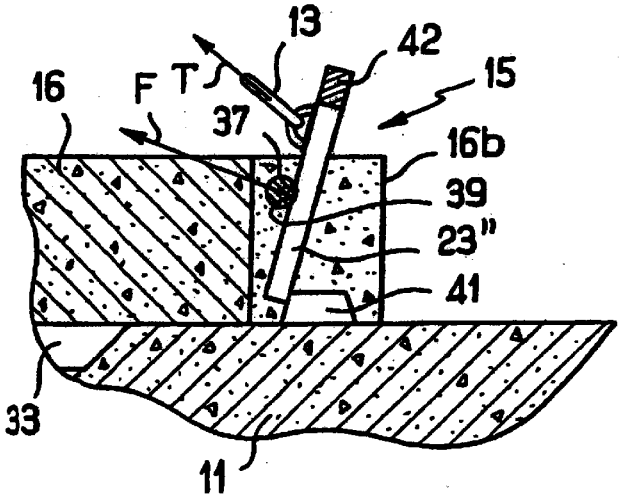
Figure 13:
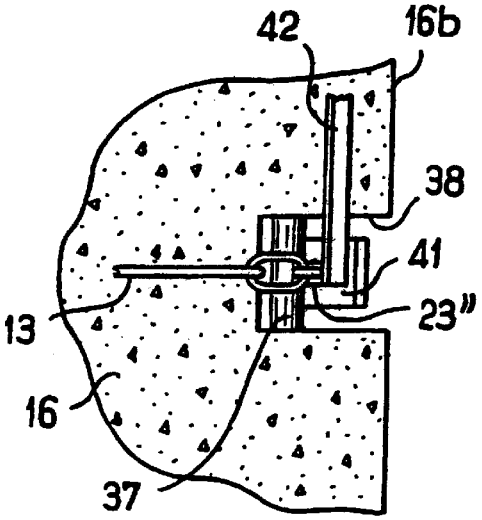
Figure 14:
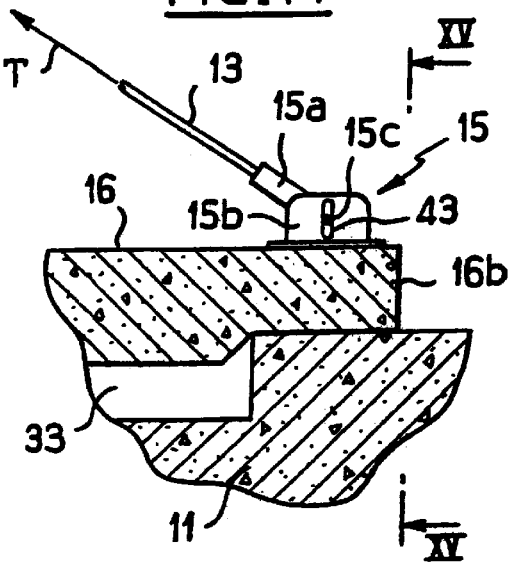
Figure 15:
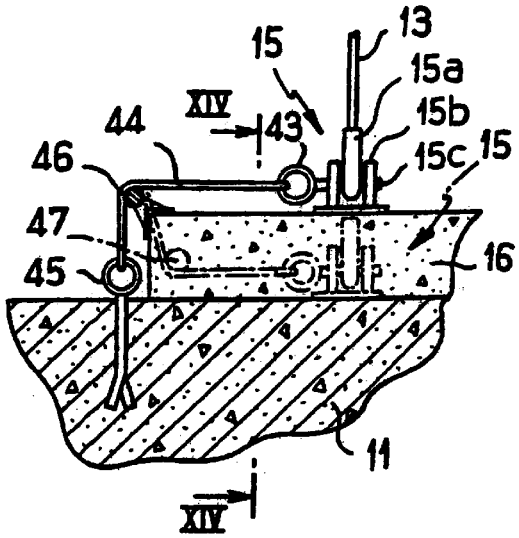
Figure 16:
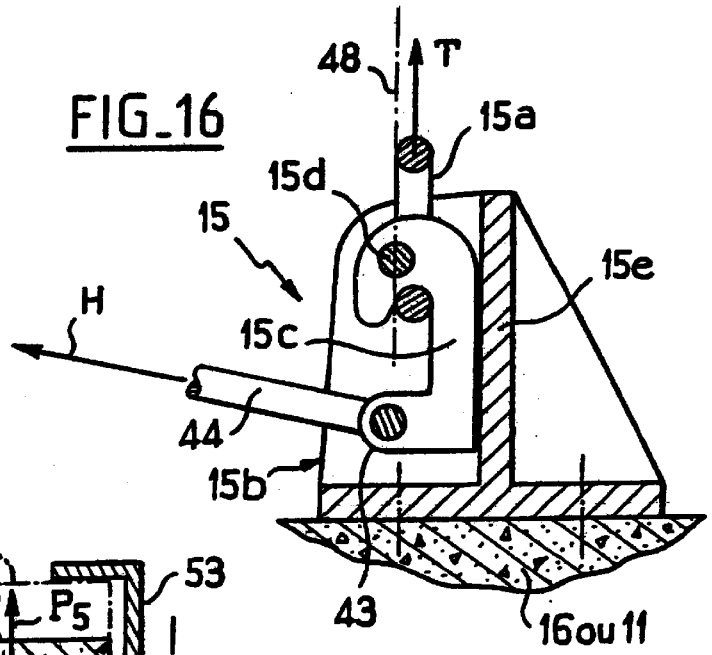
Figure 17:
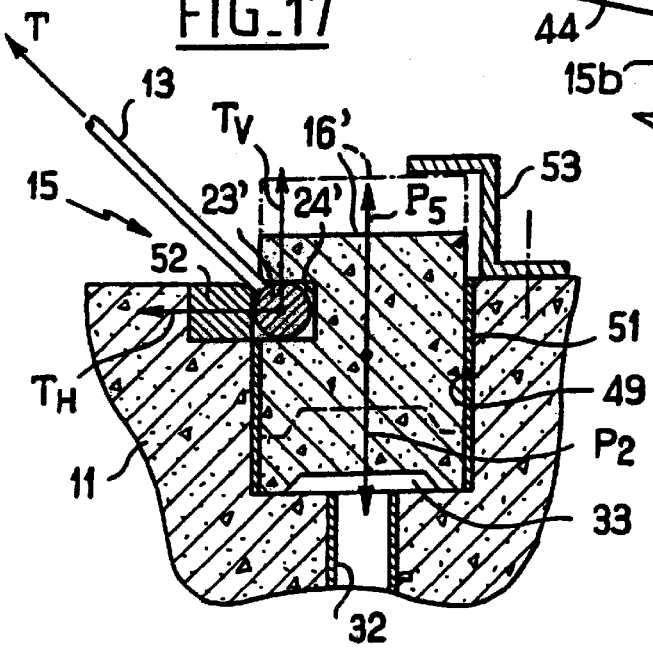
Figure 18:
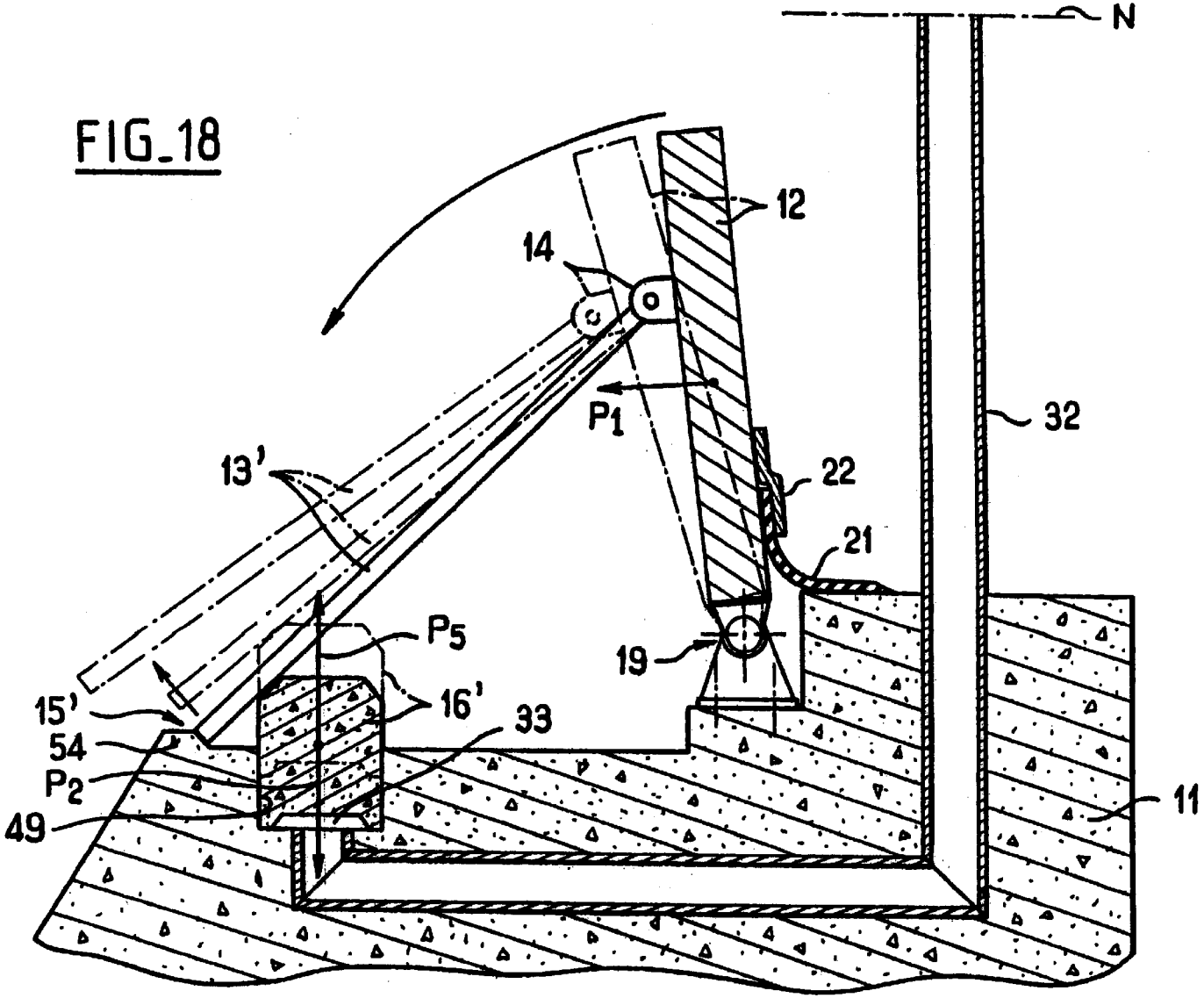
Figure 19:
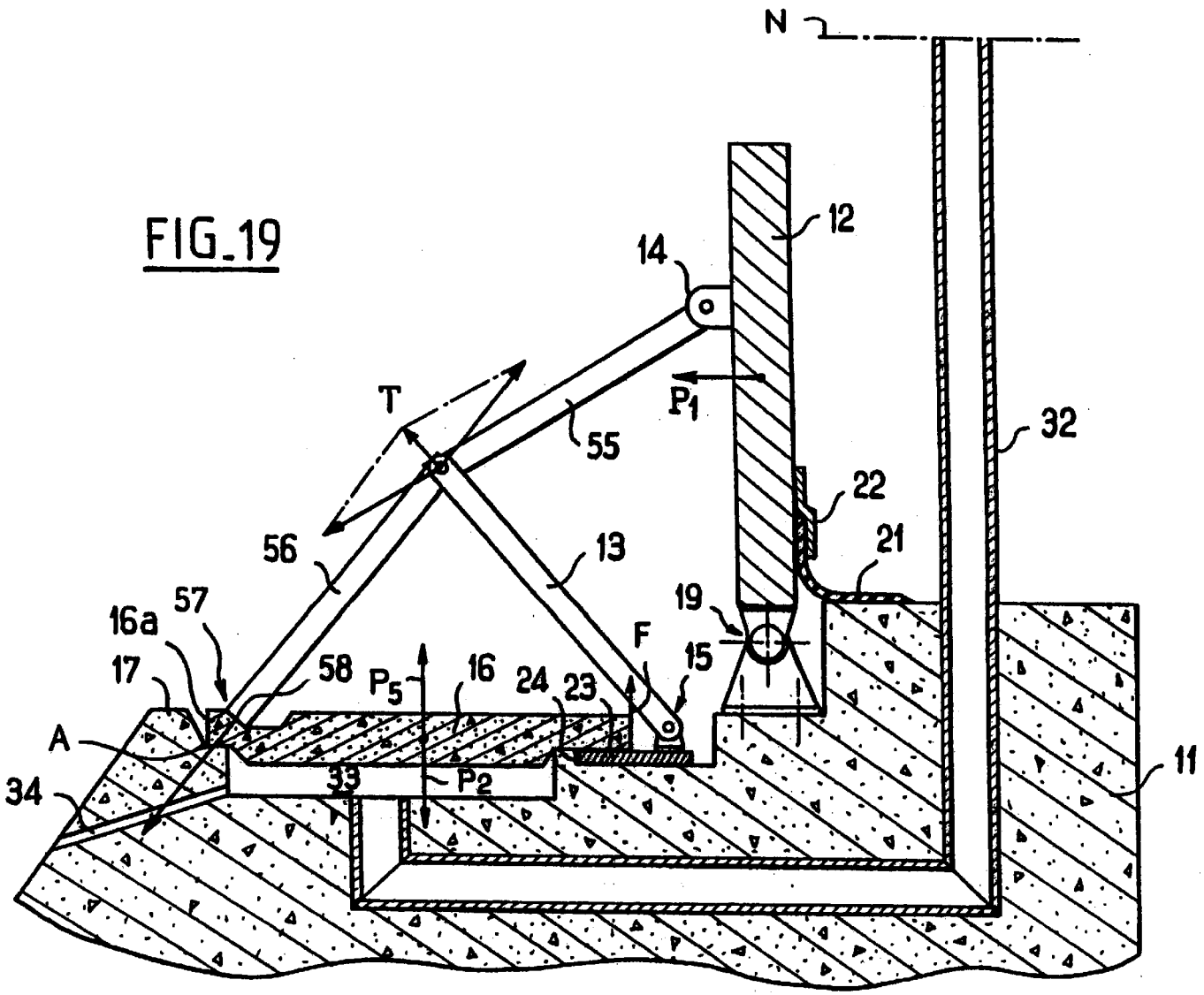

FIG. 3*a* is a view similar to FIG. 3 showing a variant embodiment of the system for triggering the automatic flashboard;

FIGS. 4, 5, 5*a*, and 5*b* are views on a larger scale showing various ways in which the wall of the flashboard can be mounted on the hydraulic structure;

FIG. 6 is a plan view of the FIG. 3 flashboard;

FIG. 7 is a view similar to FIG. 6 for a flashboard having a non-plane wall, whose horizontal section constitutes a crenellated profile;

FIGS. 8 and 9 are vertical section views showing the operation of the FIG. 3 flashboard;

FIGS. 10 and 11 are vertical section views on a larger scale showing two variant embodiments of the detachable connection connecting the tension member of the flashboard to the weir or spillway on which the flashboard is installed;

FIG. 12 is a vertical section on a larger scale showing another embodiment of said detachable connection;

FIG. 13 is a plan view of the connection shown in FIG. 12;

FIGS. 14 and 15 are vertical section views respectively on line XIV—XIV of FIG. 15 and on line XV—XV of FIG. 14 showing yet another embodiment of said detachable connection;

FIG. 16 is a vertical section view similar to that of FIG. 15 showing yet another embodiment of said detachable connection;

FIG. 17 is a vertical section view showing yet another embodiment of said detachable connection;

FIG. 18 is a vertical section view of an automatic flashboard constituting a second embodiment of the present invention; and FIG. 19 is a vertical section view showing an automatic flashboard constituting a third embodiment of the present invention.

As shown in FIG. 3, the flashboard 10 is installed on top of the masonry 11 of a hydraulic structure which is shown only in part in FIG. 3 and which, for example, may be a weir, or a spillway of a dam, or of an embankment for providing protection against flooding. In conventional manner, the flashboard 10 comprises at least one panel 12 which, in normal operation, is vertical or slightly inclined relative to the vertical and is mounted so as to be capable of tilting or pivoting about a horizontal axis that may be virtual or real, extending parallel to the bottom edge of the panel 12 and close to said bottom edge. By way of example, the panel 12 may be constituted by a metal plate, a plate of reinforced or non-reinforced concrete, a composite structure such as a metal frame having bulkhead panels fitted or fixed thereto, or any other structure forming a wall that is watertight or substantially watertight. The panel 12, or each panel 12, is held in its vertical or substantially vertical position by at least one tension member 13, e.g. by two tension members 13 as shown in FIG. 6. For example, each tension member 13 may be constituted by a metal rod, a cable, or a chain. One of the ends of each tension member 13 is connected to the panel 12 near the top thereof at 14, while the other end of each tension member 13 is attached to the masonry 11 by a detachable connection 15, several embodiments of which are described below.

As shown in FIG. 3, the flashboard 10 also includes a massive element 16 constituted in this case in the form of a rectangular slab (FIG. 6) which may be made of reinforced or non-reinforced concrete, of metal, or of reinforced or non-reinforced synthetic material. The slab 16 is laid horizontally on the masonry 11 of the weir or spillway and it is capable of tilting upwards about a horizontal axis A extending along its side 16*a*. To this end, an abutment 17 is provided on the masonry 11 immediately in front of the side 16*a* of the slab 16, with the cross-section of the abutment 17 being in the shape of a trapezium or a trapezoid. The abutment 17 may extend along the entire length of the side 16*a* of the slab 16, or it may be implemented in the form of separate blocks, as shown in FIG. 6. Under such conditions, the tilt axis A of the slab 16 coincides with the bottom edge of its side 16*a*. The abutment(s) 17 are preferably made of masonry and thus constitute an integral portion of the masonry 11 of the weir or spillway, or alternatively they may be constituted by metal pieces anchored in appropriate manner in the masonry 11. Naturally, the abutment(s) 17 may be replaced by hinges. Nevertheless, the use of one or more abutments 17, in particular masonry abutments, gives the advantage of being less subject to corrosion than are metal hinges.

In its top surface, close to its side 16*a*, The slab 16 has a groove 18 which extends parallel to said side 16*a* and which is wider than the thickness of the bottom edge of the panel 12. The bottom edge of the panel 12 is engaged in the groove 18 and bears against the side 18*a* of the groove 18 that is closer to the side 16*a* of the slab 16, as can be seen more clearly in FIG. 4. Thus, under certain conditions, as explained below, the panel 12 can tilt down about the top edge B of the side 18*a* of the groove 18.

Figure 5:
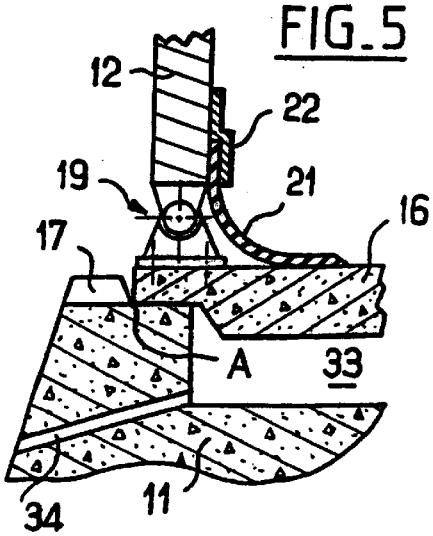

Naturally, instead of being mounted to tilt relative to the slab 16 in the manner described above, the panel 12 could be connected to the slab 16 by a hinge 19 as shown in FIG. 5. Similarly, instead of being mounted to tilt or to pivot relative to the slab 16, the panel 12 could be mounted to tilt or pivot relative to the masonry 11. For example, the groove 18 may be formed in the masonry 11 downstream from the abutment 17, as shown in FIG. 5*a*, or the hinge 19 or other equivalent means may be fixed to the masonry 11 as shown in FIG. 5*b*, likewise downstream from the abutment 17.

Figure 4:
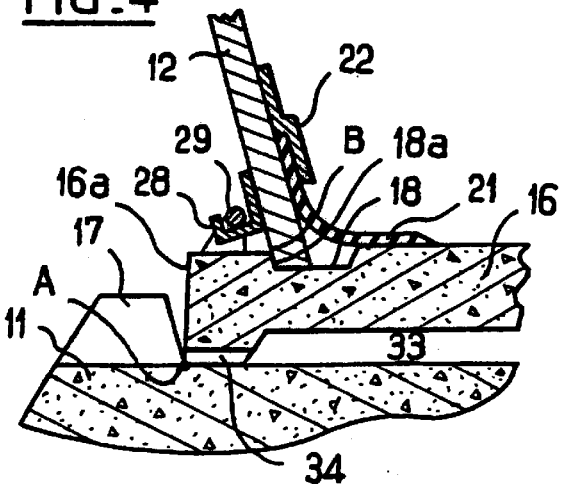

Preferably, a gasket is disposed between the panel 12 and the slab 16 or the masonry 11. For example, the gasket may be installed in the bottom of the groove 18 or, as shown in FIGS. 3 to 5, it may be constituted by a strip 21 of rubber or other elastomer material fixed by a clamp 22 to the upstream face of the panel 12 and extending downwards over the top surface of the slab 16 so as to cover the groove 18 or the hinge 19. Another gasket (not shown) may also be provided between the slab 16 and the masonry 11, in the region of the side 16*b* of the slab 16 that is opposite from its side 16*a*.

A first embodiment of the detachable connection 15 is described below. As shown in FIG. 3, the bottom end of the tension member 13 is attached to a fixing piece 23 which is engaged in and retained by a slot 24 left between the slab 16 and the masonry 11. The slot 24 extends generally horizontally beneath the slab 16 from its side 16*b* towards its side 16*a*. The fixing piece 23 is constituted in this case by a metal plate of elongate rectangular cross-section which, once engaged in the slot 24, includes a portion projecting beyond the side 16*b* of the slab 16 and having the bottom end of the tension member 13 attached thereto. As shown in FIG. 6, the two tension members 13 extend parallel to each other and both of them are attached to the same plate 23 which is of a length equal to or slightly shorter than the length of the side 16*b* of the slab 16. Nevertheless, as shown in chain-dotted lines in FIG. 6, the two tension members 13 could converge towards each other and be attached to the plate 23 at the same point located in the middle of the length of the side 16*b* of the slab 16. Under such circumstances, the plate 23 can be of a length that is considerably shorter than that shown in FIG. 6.

In operation, the mass of water 25 retained by the panel 12 exerts thrust $P_1$ thereon with the value thereof being an increasing function of the height h of the water above the top of the masonry 11. This thrust $P_1$ tends to tilt the panel 12 downwards about the edge B (FIG. 4 or 5*a*) or about the axis of the hinge 19 (FIG. 5 or 5*b*). Under the effect of the thrust $P_1$ from the mass of water 25 against the panel 12, each of the two tension members 13 is put under tension, and the tension T in each member is an increasing function of the thrust $P_1$, and thus of the height h of the water. The tension T of each tension member is transmitted to the plate 23, which as a result, tends to tilt upwards about its own edge C (see also FIG. 10). Consequently, the plate 23 applies an upwardly directed force F to the slab 16 of a magnitude that is an increasing function of the tension T. The magnitude of the force F also depends on the cosine of the angle between the direction of the tension T and the vertical, and also on the ratio between the distances $l_1$ and $l_2$ of the points at which the forces T and F are respectively applied relative to the edge C (see FIG. 10). Under the effect of the force F, the slab 16 tends to tilt upwards about the axis A formed by the bottom edge of its side 16*a*.

Also, the slab 16 is subject to its own weight $P_2$, to the weight $P_3$ of the mass of water situated above it, and to a force $P_4$ which is the resultant of the thrust $P_1$ and of the weight of the panel 12. It may be observed that the influence of this force $P_4$ on the equilibrium of the slab 16 can be eliminated or made negligible if, by construction, the direction of the force $P_4$ is caused to intersect the axis A or to pass very close thereto. In the case shown in FIGS. 5*a* and 5*b*, the force $P_4$ does not need to be taken into consideration since the panel 12 is supported by the masonry 11 and does not exert any direct action on the slab 16.

So long as the moment of the force F about the axis A remains smaller than the sum of the moments of the forces $P_2$, $P_3$, and possibly $P_4$ about the axis A, the slab 16 remains in its equilibrium position shown in FIG. 3. When the height of water h of the mass of water 25 increases, e.g. during a flood, the tension T in the tension members 13 increases and consequently the force F also increases, as does the weight $P_3$ of the mass of water 25 above the slab 16. However, the moment of the forces F about the axis A increases more quickly than the opposing moment of the weight $P_3$ about the axis A. This is due in particular to the fact that the point of application of the force F on the slab 16 is further from the axis A than the point of application of the weight $P_3$ on said slab, and also because the area of the panel 12 on which the mass of water 25 acts and which determines the value of the tension T and thus also the value of the force F is greater than, or becomes greater than, the area of the slab 16 on which the mass of water 25 acts. Consequently, as the height of the water h increases, there comes an instant, at a certain value h of the water corresponding for example to the level N (FIG. 3), at which the moment of the force F about the axis A reaches and exceeds the sum of the moments of the forces $P_2$, $P_3$, and possibly $P_4$, about the axis A. At this instant, the slab 16 is unbalanced and begins to tilt upwards about the axis A. Consequently, the slot 24 widens and water penetrates under the slab 16 and exerts upwardly-directed pressure on the bottom face thereof, thereby tending to cancel out quickly the weight $P_3$ of the water on the slab 16 and thus encouraging tilting thereof about the axis A. This causes the slot 24 to widen further (see FIG. 8) and after the slab 16 has tilted upwards through a few degrees, the plate 23 is released (see FIG. 9). At this instant, the panel 12 is no longer retained by the tension members 13, so under drive from the thrust $P_1$ from the mass of water 25 it tilts about the edge B of the groove 18 (FIG. 4 or 5*a*) or about the axis of the hinge 19 (FIG. 5 or 5*b*). Consequently, the panel 12 drops down onto the masonry 11 and releases the mass of water 25. Simultaneously, because the slab 16 is no longer subject to the action of the force F, it falls back under the effect of its own weight $P_2$ and returns to its equilibrium position as shown in FIG. 9.

In order to avoid losing the panel 12 after it has tilted down, said panel can be connected by at least one short flexible tie 26, such as a cable or a chain, to an anchor ring 27 secured to the masonry 11, as shown in FIGS. 3 and 5*a*. Instead of using one or more ties 26, it is also possible to provide at least one hook-forming element 28 which is fixed to the downstream face of the panel 12 close to the bottom edge thereof and which co-operates with a complementary retaining element 29 fixed rigidly to the slab 16, as shown in FIG. 4. Naturally, these elements can be omitted when the panel 12 is connected to the slab 16 or to the masonry 11 by a hinge such as the hinge 19 shown in FIGS. 5 and 5*b*.

From the above, it is clear that by appropriately selecting the value of the angle of inclination of the panel 12 relative to the vertical and/or the angle of the tension members 13 relative to the panel 12 (which angles also determine the value of the tension T), the values of the distances $l_1$ and $l_2$ (FIG. 10) which co-operate with the tension T to determine the value of the force F, and also the value of the weight $P_2$ of the slab 16, it is possible to ensure that unbalancing takes place and consequently that the slab 16 tilts over when the water upstream from the panel 12 reaches a predetermined level, e.g. the level N shown in FIG. 3. Under such conditions, when the water reaches the predetermined level N, the plate 23 is released, the panel 12 tilts downwards, and the mass of water 25 is released as described above.

Figure 1:
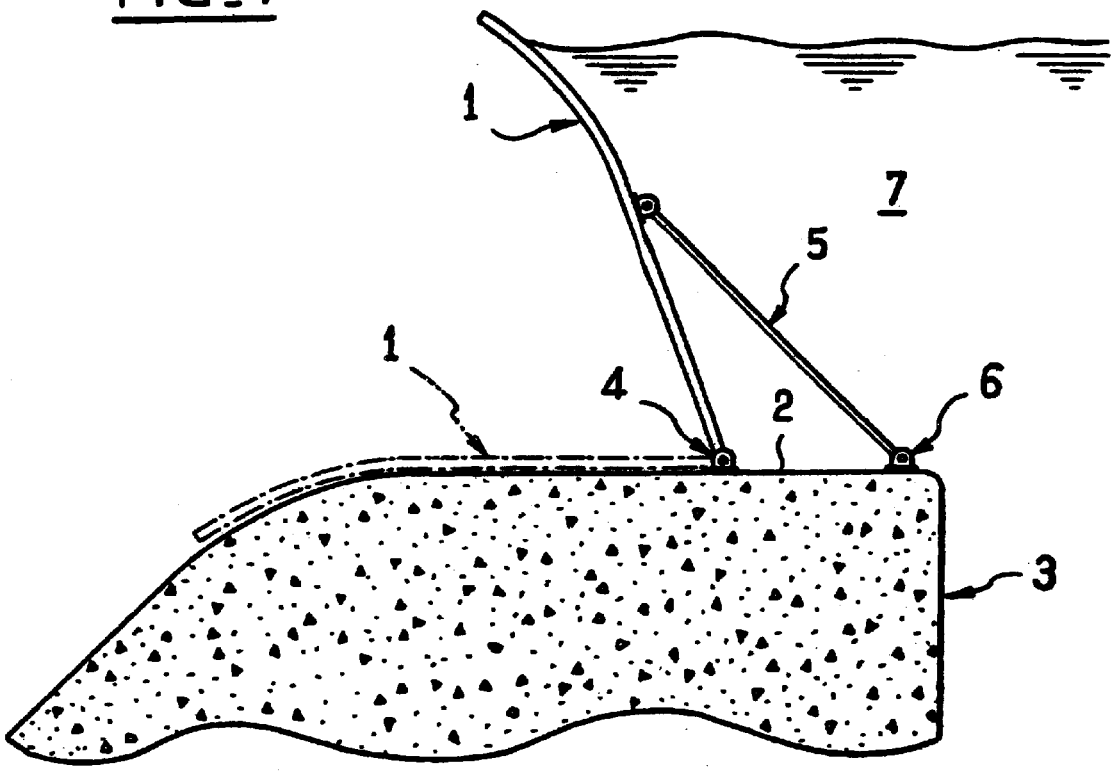
FIG. 1 is a diagrammatic side elevation of a known automatic flashboard.
Figure 2:
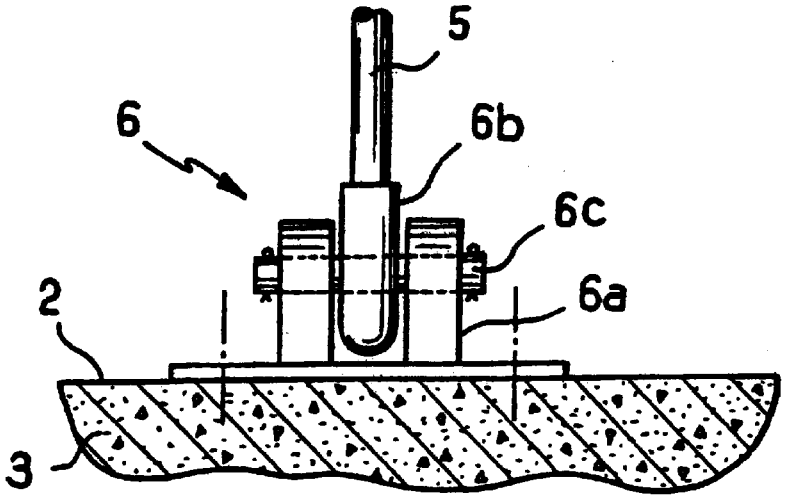
FIG. 2 shows a detail of the automatic flashboard of FIG. 1 on a larger scale.

The above-described automatic flashboard is triggered, i.e. the panel 12 is tilted from its vertical or substantially vertical position to its lowered position, not because of breakage or bending deformation of a plurality of retaining elements whose bending or breaking strength and bending or breaking behavior are known only to a greater or lesser extent, but as the result of the slab 16 moving because it is unbalanced when the water reaches a certain level. The water level at which the automatic flashboard is triggered is thus considerably more precise than is the case for previously known automatic flashboards (FIG. 1).

It will be observed that the level of water N at which triggering of the automatic flashboard takes place can be adjusted by modifying the weight of the slab 16. The heavier the slab 16, the higher the level N. To this end, ballast 31 can be fixed to the slab 16 (FIG. 3). The level N can be adjusted either by modifying the weight of the ballast 31, or by modifying the position of the ballast 31 on the slab 16, in particular its distance from the tilting axis A. Thus, when a plurality of automatic flashboards 10 are disposed side by side in conventional manner, as shown in FIG. 6, it is possible by adopting ballasts 31 of different weights and/or different positions on each of the slabs 16 of the juxtaposed flashboards 10 to ensure that the flashboards are triggered automatically and successively at different predetermined water heights.

In order to further increase the precision of the water level N that causes the automatic flashboard 10 to be triggered, means may be provided for creating uplift pressure beneath the slab 16 when the water level upstream from the panel 12 reaches the predetermined level N. To this end, a duct 32 (FIGS. 3 or 3*a*) is provided having a first end 32*a* opening out beneath the slab 16 and a second end 32*b* opening out upstream from the panel 12 at a level corresponding to the predetermined level N. The duct 32 may have a portion extending within the masonry as shown in FIG. 3, or it may be fixed vertically on the slab 16 as shown in FIG. 3*a*. The slab 16 and the duct 32 may also be formed integrally by casting concrete in appropriate shuttering. In the case shown in FIG. 3*a*, it will be observed that the above-mentioned weight $P_2$ is the total weight of the slab 16 plus the duct 32. The cross-section of the duct may be circular (FIGS. 3 and 6) or oval or elongate, having a streamlined profile as shown in chain-dotted lines at 32*c* in FIG. 3*a*.

In practice, the top end 32*b* of the duct 32 should open out at a level that is a little lower, e.g. a few centimeters lower than the predetermined level N so as to obtain a water flow rate that is sufficient to fill the duct 32 quickly when the water reaches the level N. Thus, when the water reaches the level N, upwardly directed vertical thrust $P_5$ is applied to the slab 16. This thrust $P_5$ is established in a relatively short period of time, adds to the force F, and quickly causes the slab 16 to tilt upwards about the axis A.

Preferably, the bottom face of the slab 16 (FIG. 4), or the portion of the masonry 11 lying beneath the slab 16 (FIG. 3), or both simultaneously (FIG. 10), are recessed so as to define a chamber 33 into which the end 32*a* of the duct 32 opens out. Under such circumstances, another duct or channel 34 is provided in the masonry 11 (FIG. 3) or in the bottom surface of the slab 16 (FIG. 4) to drain away downstream any water that may be found in the chamber 33, which water might be present because of lack of watertightness of the above-mentioned gaskets or because of waves that could lead to the pipe 32 filling up before the mean water level reaches the predetermined level N. It is appropriate to avoid the thrust $P_5$ being applied to the slab 16 before the water has reached the predetermined level N. The flow section of the duct 34 is smaller than that of the duct 32 so that the flow rate along the duct 34 is smaller than along the duct 32, thereby enabling the chamber 33 to be filled quickly with water in the event of the water level genuinely reaching the predetermined level N. In order to minimize the effect of waves on filling the duct 32 and the chamber 33, it is possible to provide dispositions such as those shown in FIGS. 10*a* to 10*c* of the above-mentioned French patent 2 656 354.

The above-described automatic flashboard 10 may be an overflowing or a non-overflowing flashboard depending on whether the height of the panel 12 is selected so that its top edge is at a level that is lower than or higher than the predetermined level N, respectively. For an overflowing flashboard, the panel 12 is not necessarily essentially plane in shape as shown in FIGS. 3 and 6, but it may have a non-linear profile in horizontal section, e.g. a crenellated profile such as that of the panel 12' shown in FIG. 7. In conventional manner, that makes it possible to increase the length of the top of the panel and thus to increase the flow rate of the sheet of water overflowing the top of the panel for a given water level. Thus, by adopting a panel whose top has a non-linear profile, e.g. a crenellated profile like that of the panel 12', it is possible for the panel 12' to be of a height that is greater than the height that would be necessary for a plane panel of rectilinear top profile constituting an automatic flashboard capable of discharging a flood at a predetermined flow rate (design flood) without the flashboard triggering automatically, i.e. so long as the water level remains below the predetermined level N.

For an overflow flashboard or for a flashboard installed on a weir, a certain mass of water may be present on the downstream side of the panel 12 at a level that is lower than the level of the water on the upstream side of the panel 12. Under such circumstances, the mass of water downstream from the panel 12 can exert a thrust on the downstream face thereof that counterbalances in part the thrust $P_1$ of the water on the upstream face of the panel 12. The thrust exerted on the downstream face of the panel 12 has the effect of reducing the value of the tension T in the tension members 13, and thus also of reducing the value of the force F that tends to tilt the slab 16 upwards. In this case, it is therefore appropriate to take said thrust into consideration when determining the tension T and the force F. To compensate for the reduction in the value of the force F, it may be necessary, for example, to reduce the weight of the slab 16, or the weight of the ballast 31, or to place the ballast 31 closer to the axis A.

FIG. 10 shows a variant embodiment of the detachable connection 15. In this case, each tension member 13 is constituted at least in part by a flexible element such as a cable or a chain, and it passes around a deflector element 35 which is fixed on the slab 16 close to its side 16*b* so that the end portion of the tension member 13 which is attached to the plate 23 extends more or less vertically. Under such conditions, the moment of the tension T of the tension members 13 about the axis C has a value that is greater than in the case shown in FIG. 3. The deflector element 35 may be constituted, for example, by a roller, by a pulley, or as shown, by a fixed cylindrical bar carried by supports 36 fixed to the slab 16.

FIG. 11 shows another embodiment of the detachable connection 15. In this case, the slot 24 formed between the slab 16 and the masonry 11 has a cross-section that is in the form of an inverted-L shape, with a first branch extending horizontally beneath the slab 16 from its side 16*b* and towards its side 16*a* (not shown in FIG. 11), and a second branch extending vertically downwards from the inner end of the first branch. The second or vertical branch of the slot 24 is wider than the first or horizontal branch of said slot. As shown in FIG. 11, the side 16*b* of the slab 16 is implemented in rounded form. Here again, each tension member 13 is constituted, at least in part, by a flexible element such as a cable or a chain passing around the rounded side 16*b* of the slab 16. Thereafter each tension member 13 passes into the horizontal branch of the slot 24 and it is attached to the fixing piece 23' which is engaged in the vertical branch of the slot 24. By way of example, the fixing piece 23' may be constituted by a cylindrical bar of diameter greater than the width of the horizontal branch of the slot 24, but smaller than the width of the vertical branch of said slot. The detachable connection 15 shown in FIG. 11 operates as follows. As in the embodiments described above, the tension members 13 when under tension tend to tilt the slab 16 about the axis A (FIG. 3). When the water reaches the predetermined level N, the slab 16 tilts upwards and as soon as the width of the horizontal branch of the slot 24 becomes larger than the diameter of the round section of the bar 23', the bar is extracted from the slot 24 under the effect of the tension in the member 13, such that the panel 12 is no longer retained and can drop down under the thrust $P_1$ of the water.

FIGS. 12 and 13 show yet another embodiment of the detachable connection 15. In this embodiment, each tension member 13 is attached to one end of a fixing piece 23" that forms a lever. A fulcrum 37 for the lever 23" is provided on the side of the slab 16 remote from the side 16*a* thereof, e.g. close to the side 16*b* of the slab. As shown in FIGS. 12 and 13, a notch 38 may be formed in the side 16*b* of the slab 16 and the fulcrum 37 may be constituted by a bar, e.g. a horizontal-axis cylindrical bar that passes through the notch 38 and that has its ends embedded in the slab 16. At the location where the lever 23" comes into contact with the bar 37, the lever preferably includes an indentation 39 e.g. of shape complementary to that of the bar 37. A stop 41 is formed on the masonry 11 beneath the bar 37. The stop may be integral with the masonry 11 or it may be constituted by a metal piece anchored in appropriate manner to the masonry 11. A respective lever 23" may be associated with each of the two tension members 13. In which case, the two levers 23" may be rigidly coupled together by a cross-bar 42. Nevertheless, if the notch 38 is formed in the middle of the length of the side 16*b* of the slab 16, both tension members 13 may be attached to a single lever 23".

In operation, the tension member(s) 13 exert traction on the top end(s) of the lever(s) 23" tending to pivot said lever(s) 23" counterclockwise about the fulcrum constituted by the cylindrical bar 37, thereby keeping the bottom end(s) of the lever(s) 23" against the respective stop(s) 41. As a result, the lever(s) 23" apply(ies) a force F to the fulcrum 37 and thus to the slab 16 tending to tilt the slab about the axis A (FIG. 3). When the water reaches the predetermined level N and the slab 16 tilts upwards about the axis A, the bottom end of the lever 23" (or of each lever 23") escapes from the stop 41 by sliding thereover, so that the fixing piece constituted by the lever 23" is released and the panel 12 is no longer retained and can therefore drop down under the thrust $P_1$ of the water.

FIGS. 14 and 15 show yet another embodiment of the detachable connection 15. In this embodiment, the bottom end of each tension member 13 (or of both tension members 13) is connected to the masonry 11 or to the slab 16, preferably close to the side 16*b* thereof, by a fastening comprising a ring or eye 15*a* fixed to the tension member 13, a fork or "clevis" 15*b* fixed to the slab 16 as shown in solid lines in FIGS. 14 or 15, or to the masonry 11 as shown in chain-dotted lines in FIG. 15, and a pin 15*c* that detachably couples the eye 15*a* and the clevis 15*b*. The pin 15*c* has a ring 43 attached to one of the ends of a flexible tie 44 such as a cable or a chain, whose other end is attached to a ring 45 anchored to the masonry 11. Going from the ring 45, the tie 44 initially extends upwards, vertically or substantially vertically, and then passes around a deflector element 46 fixed to the slab 16, after which it extends horizontally or substantially horizontally to the ring 43 when the clevis 15*b* is fixed to the slab 16. When the clevis 15*b* is fixed to the masonry 11, the tie 44 passes around the deflector element 46 and then extends vertically or substantially vertically downwards before passing around another deflector element 47 that is fixed to the masonry 11, after which it continues horizontally or substantially horizontally to the ring 43 of the pin 15*c*. In both cases, when the water level reaches the predetermined level N and the slab 16 tilts about the axis A (FIG. 3) under the effect of the traction T exerted by the tension member(s) 13 and/or under the effect of the thrust $P_5$ of the water that has penetrated into the chamber 33 via the duct 32 (FIG. 3), the deflector element 46 moves upwards together with the slab 16 and exerts traction on the tie 44. As a result, the pin 15*c*, pulled by the tie 44, is extracted from the ring 15*a* and the clevis 15*b*, and uncouples those two elements. Since the panel 12 is no longer retained, it can drop down under the thrust $P_1$ of the water.

When the clevis 15*b* of the fastening 15 is fixed to the masonry 11, this solution presents the advantage, compared with the case of the clevis 15*b* being fixed to the slab 16, that the automatic flashboard 10 is completely insensitive to any shock that may be generated by a floating body striking the panel 12 or the tension members 13. With this solution, the tension members 13 no longer exert any action on the slab 16. In this case, the slab 16 is caused to tilt about the axis A solely by the thrust $P_5$ of the water penetrating into the chamber 33 via the duct 32. Consequently, the slab 16 must be lighter in weight than in the case where the tension members 13 exert action on said slab, and more precisely the density of the slab 16 must be less than that of water.

FIG. 16 shows another variant embodiment of the fastening 15 of FIGS. 14 and 15. In FIG. 16, the elements that perform the same functions as those shown in FIGS. 14 and 15 are designated by the same reference numerals. In the fastening 15 of FIG. 16, the ring or eye 15*a* which is fixed to the tension member 13 is coupled in detachable manner to the clevis 15*b* which is fixed to the slab 16 or to the masonry 11 by means of a hook 15*c* that is capable of pivoting about an axis 15*d* of the clevis 15*b*. The hook 15*c* is provided with a ring or eye 43 to which the tie 44 is attached. In normal operation, so long as the water level remains below the predetermined level N, the traction exerted by the tension member 13 on the ring 15*a* tends to pivot the hook 15*c* counterclockwise about the axis 15*d*, and said hook is kept pressed against the plate 15*e* of the clevis 15*b*. When the water reaches the predetermined level N and the slab 16 tilts upwards about the axis A, the deflector element 46 (FIG. 15) exerts a traction force on the tie 44, thereby pulling said tie in the direction given by arrow H in FIG. 16. This traction force has the effect of pivoting the lever 15*c* clockwise about the axis 15*d*. As soon as the midplane of the ring 15*a* has gone past the vertical line 48 itself passing through the center of the circular section of the axis 15*d*, the hook 15*c* opens automatically under the effect of the traction T exerted by the tension member on the ring 15*a*. It can thus be seen that very small displacement of the slab 16 suffices to detach the ring 15*a* from the hook 15*c*.

In the embodiments described above, the massive element whose displacement gives rise to disconnection of the detachable connection 15 is constituted by a slab 16 that is capable of pivoting about a horizontal axis A. Nevertheless, the present invention is not limited to using a massive element in the form of a tilting slab.

As shown in FIG. 17, the massive element may be constituted by a block 16', e.g. of concrete or of reinforced concrete, that is mounted in such a manner as to be capable of sliding vertically in an upwardly open cavity 49 formed in the masonry 11. The vertical walls of the cavity 49 may be lined with a coating 51 having a low coefficient of friction relative to the substance constituting the block 16'. On one of its sides, the block 16' may include a notch 24' which, in normal operation, is closed at least in part by one of the vertical walls of the cavity 49 when the block 16' is in its stable state bearing against the bottom of the cavity 49. The bottom end of the tension member 13 or each bottom end of the two tension members 13 is attached to a fixing piece 23'held captive in the notch 24'. As in the embodiment of FIG. 11, the fixing piece 23' may be constituted by a preferably-cylindrical metal bar.

In operation, under the effect of the traction T from the tension member 13, the bar 23' is subjected to a force that can be resolved into a horizontal component $T_H$ and a vertical component $T_V$. The horizontal component $T_H$ is absorbed by the masonry 11 or by a metal reinforcing piece 52 suitably anchored in the masonry 11. The vertical component $T_V$ acts on the block 16' and tends to lift it. The weight $P_2$ of the block 16' is selected so that the vertical component $T_V$ whose value increases when the level of the mass of water upstream from the panel 12 increases, reaches and exceeds the sum of the weight $P_2$ and of the weight of the column of water above the block 16 when the water reaches the predetermined level N. Under such conditions, the block 16' is lifted, the notch 24' is then cleared, and the bar 23' is released. This results in the panel 12 no longer being retained, and it can drop down under the thrust $P_1$ of the water. A retaining element 53 having a Z-shaped profile can be fixed to the masonry 11 so as to limit upward displacement of the block 16'. Nevertheless, such a retaining element 53 is not essential. Once the bar 23' has been released, it ceases to apply any vertical force to the block 16' which then falls back under the effect of its own weight $P_2$ to the bottom of the cavity 49.

As in the embodiment of FIG. 3 where the massive element is constituted by a slab 16, a chamber 33 communicating with a duct 32 similar to the duct 32 of FIG. 3 can be provided beneath the block 16' between the block and the bottom of the cavity 49. The chamber 33 may be formed either by hollowing out the bottom surface of the block 16', or by hollowing out the bottom of the cavity 49, or by hollowing both of them out. Here again, the thrust $P_5$ which is applied to the block 16' when the water upstream from the panel 12 reaches the level N serves to further improve the precision of the water level that actually gives rise to automatic triggering of the flashboard.

In the embodiment of FIG. 17, it will be observed that the detachable connection 15 which is constituted in this case by the fixing piece 23' and by the notch 24', can be replaced by a connection of the same type as those described above with reference to FIGS. 10 to 16.

In the embodiments described above, it is assumed that the massive element 16 or 16' is located for the most part (FIGS. 3, 3*a*, 4, and 5), or completely (FIGS. 5*a*, 5*b*, and 17), on the upstream side of the panel 12. Nevertheless, the massive element 16 or 16' can be located downstream from the panel 12, as shown in FIGS. 18 and 19.

In the embodiment of FIG. 18, the elongate element retaining the panel 12 against the thrust $P_1$ of the mass of water located upstream from the panel 12 is constituted by at least one rigid stay or strut 13'. The stay 13' has a first thrust point at 14 against the downstream face of the panel 12 and a second thrust point at 15' against the masonry 11. The thrust point 14 may be constituted, for example, by a hinge, whereas the thrust point 15' is constituted merely by an abutment 54 integrally formed in the masonry 11 or constituted by a metal piece appropriately fixed to the masonry 11. Nevertheless, the hinge 14 could be located in the position of the abutment 54 and the abutment 54 in the location of the hinge 14. In this case, the thrust point 15' formed by the abutment 54 constitutes the above-mentioned detachable connection.

In addition, and as shown in FIG. 18, the massive element whose displacement causes the flashboard to be triggered when the water level upstream from the panel 12 reaches the predetermined level N, can be constituted, for example, by a block 16' similar to that described with reference to FIG. 17, but lacking the notch 24'. The stay 13' passes immediately above the block 16' so that when the block is raised, the stay 13' is dislodged from the thrust point 15' constituted by the abutment 54, as shown in FIG. 18, after which the panel 12 can drop down under the thrust $P_1$ of the water. In this embodiment, the block 16' is displaced solely by the thrust $P_5$ of the water penetrating into the chamber 33 via the duct 32 when the water level reaches the predetermined level N. A retaining element similar to the element 53 of FIG. 17 may be necessary to limit upward displacement of the block 16'.

In the embodiment of FIG. 19, the top end of the tension member 13 is connected indirectly to the panel 12 via a first link 55 of a pair of hinged links 55 and 56. The second link 56 of said pair of links bears directly or indirectly against the masonry 11 at 57. In the example shown in FIG. 19, the massive element 16 is constituted by a slab similar to that shown in FIG. 3, and the second link 56 bears against an abutment 58 formed on the slab 16 close to its side 16*a*. Nevertheless, the abutment 58 could be formed on the masonry 11. The first link 55 is hinged at 14 to the downstream face of the panel 12.

As in the embodiment of FIG. 3, an abutment 17 for the slab 16 is provided on the masonry 11. The bottom end of the tension member 13 is connected to the masonry 11 via a detachable connection 15 similar to that described with reference to FIG. 3. Nevertheless, the detachable connection 15 shown in FIG. 19 could be replaced by any of the connections shown in FIGS. 10 to 17. Similarly, the slab 16 could be replaced by a sliding block 16' like that of FIG. 17.

In the above-described automatic flashboards, it will be observed that from the point of view of transmitting the forces T, F, and $P_5$ which are generated by the mass of water 25 and applied to the slab 16 or to the block 16', the panel 12, the tension member 13, and the detachable connection 15 together constitute a mechanical coupling system between the slab 16 or the block 16' and the mass of water 25, while the duct 32 constitutes a hydraulic coupling system between the slab 16 or the block 16' and the mass of water 25. When the water reaches the predetermined level N, the detachable connection 15 or 15' is eliminated in response to displacement of the slab 16 or of the block 16' either under the effect of the mechanical coupling system on its own, or under the effect of the hydraulic coupling system on its own, or indeed under the combined effect of both coupling systems together, depending on the embodiment concerned.

Naturally, the embodiments described above are given purely by way of non-limiting indication, and numerous modifications can be applied thereto by the person skilled in the art without thereby going beyond the ambit of the present invention.

What is claimed is:

1. An automatic flashboard for a hydraulic structure (11) such as a weir, or a spillway on a dam or on a protective embankment, the flashboard comprising:

(A) a watertight or substantially watertight wall (12) installed on said structure (11) so as to be capable of passing from an erect, first position for retaining a mass of water to a lowered, second position in which said wall (12) allows water to pass essentially without obstruction, and (B) at least one elongate retaining element (13; 13') for holding said wall (12) in its first position against a horizontal thrust ($P_1$) exerted by the mass of water (25), said elongate retaining element (13; 13') being connected to said wall (12) via a connection (14) and being subjected in operation, under thrust from the water, to a longitudinal force (T), extending between said wall (12) and a reaction point remote from said wall (12) and counterbalancing said longitudinal force, and being connected to the reaction point via a connection (15, 15') that can be eliminated without human intervention when the water reaches a certain level, such that said wall (12) passes automatically into its second position, said flashboard being characterized in that it further comprises:

(C) a massive element (16; 16') movably mounted on said structure (11) and coupled to said mass of water so as to be in a position of stable equilibrium so long as the water remains below a predetermined level (N) and so as to pass into an unstable state and be displaced when the water reaches said predetermined level, said connection (15) being eliminated by the displacement of said massive element (16, 16').

2. A flashboard according to claim 1, characterized in that said massive element is constituted by a slab (16) installed on said structure (11) so as to be capable of tilting upwards about a horizontal axis (A) which extends along a first side (16*a*) of the slab (16) and which is perpendicular to the direction of the thrust ($P_1$) exerted by the mass of water (25) on said wall (12).

3. A flashboard according to claim 1, characterized in that the massive element (16') is mounted so as to be capable of sliding vertically in an upwardly open cavity (49) formed in said structure (11).

4. A flashboard according to claim 2, characterized in that said elongate retaining element is constituted by a tension member (13) having a first end connected (at 14) to said wall (12) in an upper region thereof, and having a second end attached to a fixing piece (23; 23'; 23") which is engaged and retained in a space (24; 24') formed between said massive element (16; 16') and said structure (11) in such a manner that, when the tension member (13) is under tension due to said thrust ($P_1$) from the water, the massive element (16; 16') is subjected to a force (F; $T_V$) of a value that increases as a function of the level of the water and which is directed in a direction such that it tends to raise said massive element (16; 16'), and that when the water reaches said predetermined level (N), causing the massive element to be lifted, said space (24; 24') enlarges and releases the fixing piece (23; 23'; 23").

5. A flashboard according to claim 4, characterized in that said space is constituted by a slot (24) extending generally horizontally beneath the slab (16) from a second side (16*b*) thereof remote from its first side (16*a*) towards said first side of the slab, and in that said fixing piece is constituted by a plate (23) of elongate rectangular cross-section which, when engaged in said slot (24), includes a portion that projects beyond the second side (16*b*) of the slab (16) and to which the second end of the tension member (13) is attached.

6. A flashboard according to claim 5, characterized in that said tension member (13) is constituted at least in part by a flexible element such as a cable or a chain, passing around a deflector element (35) fixed to said slab (16) in the region of said second side (16*b*) thereof, whereby the end portion of said tension member (13) attached to the plate (23) extends substantially vertically.

7. A flashboard according to claims 2 and 4, characterized in that said space is a slot (24) of an inverted-L shape-cross-section having a first branch extending horizontally beneath said slab (16) from a second side (16*b*) thereof remote from its first side (16*a*) towards said first side, and having a second branch extending vertically downwards from the inner end of the first branch and of width greater than that of the first branch, in that said slab (16) has a rounded second side (16*b*), and in that said tension member (13) is constituted at least in part by a flexible element such as a cable or a chain passing around the rounded side of said slab (16) and then into the first branch of said slot (24) and is attached to said fixing piece (23') which is engaged in the second branch of said slot (24).

8. A flashboard according to claim 7, characterized in that said fixing piece (23') is round in section having a diameter greater than the width of the first branch of said slot (24) and smaller than the width of the second branch of said slot.

9. A flashboard according to claim 2, characterized in that said elongate retaining element is constituted by a tension member (13) having one end connected (at 14) to said wall (12) in a top region thereof, and having its other end attached to a first end of a lever-forming fixing piece (23"), in that a fulcrum (37) for the lever (23") is provided on one side (16*b*) of said slab (16) remote from the first side (16*a*) thereof, and in that a stop (41) for a second end of the lever (23") is provided on said structure (11) beneath said fulcrum (37) in such a manner that when the tension member (13) is under tension due to the thrust ($P_1$) exerted on said wall (12) by the water, the first end of the lever (23") is subjected to a force (T) whose value increases as a function of the level of the water and which tends to pivot the lever (23") about said fulcrum (37) and holds the second end of the lever (23") against said stop (41), said force (T) being converted by the lever (23") into a force (F) which is applied to the slab (16) and which tends to cause it to tilt upwards about said horizontal axis (A) so that, when the water reaches said predetermined level (N) and causes the slab (16) to tilt upwardly through a few degrees, the second end of the lever (23") escapes from the stop (41) by sliding thereover, and the lever-forming fixing piece (23") is released.

10. A flashboard according to claim 3, characterized in that said space is constituted by a notch (24') formed in one side of the massive element (16'), said notch (24') being closed, at least in part, by a vertical wall of said cavity (49) when the massive element (16') is in its stable position bearing against the bottom of the cavity (49), and being cleared and opened when the massive element (16') is raised.

11. A flashboard according to claim 4, characterized in that at least two tension members (13) are provided which are connected firstly to said wall (12) at points (14) that are horizontally spaced apart, and secondly to said fixing piece (23; 23'; 23").

12. A flashboard according to claim 11, characterized in that the fixing piece (23; 23'; 23") is the same for both tension members (13).

13. A flashboard according to claim 11, characterized in that each tension member (13) is attached to a respective lever-forming fixing piece (23"), and in that the two levers (23") are rigidly coupled together by a cross-bar (42).

14. A flashboard according to claim 1, characterized in that said elongate retaining element is constituted by a tension member (13) having a first end connected (at 14) to said wall (12) in the top region thereof, and having a second end connected to the massive element (16; 16') by a fastening (15), such that when said tension member (13) is under tension due to said thrust ($P_1$) of the water, the massive element (16; 16') is subjected to an upwardly directed force whose value increases as a function of the level of the water and which tends to raise said massive element (16; 16'), in that said fastening (15) comprises first and second parts (15*a*, 15*b*) which are connected respectively to the tension member (13) and to the massive element (16; 16'), and a third part (15*c*) which is movable and which detachably couples together the first and second parts of the fastening (15), and in that a tie (44) connects the third part (15*c*) of the fastening to a fixed point (45) of the structure (11) such that when the water reaches said predetermined level (N) and the massive element (16; 16') is raised together with the first and second parts (15*a*, 15*b*) of the fastening (15), the third part (15*c*) of the fastening is retained by said tie (44) and uncouples the first and second parts of the fastening.

15. A flashboard according to claim 2, characterized in that the top surface of the slab (16) includes a groove (18) extending along at least a portion of the first side (16*a*) of the slab (16) and of a width that is greater than the thickness of the bottom edge of said wall (12) which is engaged in said groove (18) in such a manner that said wall (12) can tilt about the closer of the edges (B) of the groove (18) to the first side (16*a*) of the slab (16).

16. A flashboard according to claim 15, characterized in that said wall (12) is connected to a fixed point (27) of the structure (11) by at least one short flexible tie (26) such as a cable or a chain.

17. A flashboard according to claim 15, characterized in that at least one hook-forming element (28) is fixed to said wall (12) on its face opposite from the face retaining the water, close to the bottom edge of said wall, and co-operating with a complementary retaining element (29) rigidly fixed to said slab (16).

18. A flashboard according to claim 2, characterized in that said wall (12) is pivotally mounted on the slab (16) by means of a hinge (19) having a horizontal hinge axis perpendicular to the direction of said thrust ($P_1$) of the water.

19. A flashboard according to claim 4, characterized in that the massive element (16; 16') has at least a major portion thereof on the water-retaining side of said wall (12), and in that the first end of the tension member (13) is connected directly (at 14) to said wall (12).

20. A flashboard according to any one of claims 4 to 18, characterized in that the massive element (16; 16') is on the side of said wall (12) remote from its water-retaining side, and in that the first end of the tension member (13) is connected indirectly to said wall (12) via a first link (55) of a pair of hinged links (55, 56), a second link (56) of said pair of links bearing (at 57) against an abutment provided on said structure (11).

21. A flashboard according to claim 4, characterized in that a first duct (32) is provided having a first end (32*a*) opening out beneath said massive element (16; 16'), and a second end (32*b*) located on the water-retaining side of said wall (12) and opening out at a level that corresponds to said predetermined level (N), so that when the water reaches said predetermined level (N), said first duct (32) fills with water and applies upwardly-directed vertical thrust ($P_5$) to the massive element (16; 16').

22. A flashboard according to claim 21, characterized in that a portion of the duct (32) extends in said structure (11).

23. A flashboard according to claim 21, characterized in that the duct (32) is fixed to the slab (16) or is integrally formed therewith.

24. A flashboard according to claim 21, characterized in that the bottom face of the massive element (16; 16') and/or a portion of the structure (11) located beneath the massive element is/are hollowed out so as to define a chamber (33) into which the first end (32*a*) of the first duct (32) opens out.

25. A flashboard according to claim 24, characterized in that a second duct (34) of flow section that is smaller than that of the first duct (32) is provided to drain said chamber (33).

26. A flashboard according to claim 21, characterized in that said massive element (16; 16') is on the side of said wall (12) opposite from its water-retaining side, and in that said elongate retaining element is constituted by a rigid strut (13') having a first thrust point (at 14) against said wall (12) and a second thrust point (at 15') against said structure (11), said strut passing immediately above said massive element (16; 16') in such a manner that when the massive element is raised, said strut (13') is dislodged from one (15') of its two thrust points (14, 15'), and said wall (12) can move from its first position to its second position.

27. A flashboard according to claim 1, characterized in that said wall (12) is essentially plane.

28. A flashboard according to claim 1, characterized in that said wall (12'), when seen in horizontal section, has a profile that is not linear.

* * * * *

UNITED STATES PATENT AND TRADEMARK OFFICE

CERTIFICATE OF CORRECTION

PATENT NO. : 6,196,764 B1
DATED : March 6, 2001
INVENTOR(S) : Julien Rayssiguier It is certified that error appears in the above-identified patent and that said Letters Patent is hereby corrected as shown below:

Title page,
Item [75] Inventor, delete "Bayssiguier" and add -- Rayssiguier --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*